US005706561A

United States Patent [19]

Kipperman

[11] Patent Number: 5,706,561

[45] Date of Patent: Jan. 13, 1998

[54] SPRING CLIP AND METHOD FOR MAKING SAME

[75] Inventor: Ronald Kipperman, Pompano Beach, Fla.

[73] Assignee: Mississippi Trading, Inc., Miramar, Fla.

[21] Appl. No.: 705,137

[22] Filed: Aug. 29, 1996

[51] Int. Cl.[6] ..... A41F 1/00; A44B 11/00

[52] U.S. Cl. ..... 24/668; 24/666; 24/701

[58] Field of Search ..... 24/668, 666, 667, 24/701, 546, 67.9, 3.6, 265 AL

[56] References Cited

U.S. PATENT DOCUMENTS

| | | | |
|---|---|---|---|
| D. 56,042 | 8/1920 | Warner . | |
| D. 306,272 | 2/1990 | Kruger . | |
| D. 358,567 | 5/1995 | Sirois . | |
| 1,232,503 | 7/1917 | Comstock, Sr. | 24/668 |
| 1,314,290 | 8/1919 | Wilton | 24/668 |
| 1,346,911 | 7/1920 | Peterson . | |
| 1,677,078 | 7/1928 | Garrett | 24/668 |
| 1,695,056 | 2/1928 | Mosgrove . | |
| 1,762,264 | 6/1930 | Domkee | 24/668 |
| 1,775,101 | 9/1930 | Hodge . | |
| 1,798,146 | 3/1931 | Domkee . | |
| 1,824,547 | 9/1931 | Hodge . | |
| 1,831,804 | 11/1931 | Domkee . | |
| 1,832,191 | 11/1931 | Domkee . | |
| 1,844,282 | 2/1932 | Hodge . | |
| 1,844,283 | 2/1932 | Hodge . | |
| 1,890,692 | 12/1932 | Mosgrove | 24/668 |
| 2,146,496 | 2/1939 | Tilly . | |
| 3,577,609 | 5/1971 | Gottfried . | |
| 3,911,537 | 10/1975 | Mazur . | |
| 4,204,300 | 5/1980 | Fildan . | |
| 4,935,997 | 6/1990 | Hirsch . | |
| 5,005,269 | 4/1991 | Hirsch . | |

*Primary Examiner*—Victor N. Sakran
*Attorney, Agent, or Firm*—Mauro Premutico

[57] ABSTRACT

The present invention relates to an improved garment loop for engaging and disengaging a button. In a preferred embodiment, the loop is manufactured from a single piece of wire which provides for resilient movement of a button receiving portion by means of a interlocked sliding horizontal strap bar.

3 Claims, 1 Drawing Sheet

SPRING CLIP AND METHOD FOR MAKING SAME

FIELD OF USE

The invention relates generally to an improved spring clip for engaging buttons on garments and more specifically to a button loop for supporting shoulder straps on overalls.

BACKGROUND OF THE INVENTION

Currently most garment spring clips of the type used to support straps on overalls, commonly referred to as button loops or overall clips, consist of a wire loop form having a pair of arms which are shaped to provide a button receiving portion for engaging the stem of a button on a bib of a garment. The pair of arms are spring biased towards a closed position and are usually retained in alignment by a stamped piece of sheet metal, sometimes referred to as the encasement. The sheet metal also prevents the arms from being opened to such an extent as to deform the arms and remove their spring action. Examples of such devices are shown in U.S. Pat. Nos. 1,346,911 to C. E. Peterson; 1,775,101 to R. J. Hodge; 1,798,146 to J. H. Domkee; 1,824,547 to R. J. Hodge; 1,831,804 to J. H. Domkee; 1,832,191 to J. H. Domkee; 1,844,282 to R. J. Hodge; 1,844,283 to R. J. Hodge; 2,146,496 to C. E. Anderson; 4,935,997 to N. A. Hirsch; and 5,005,269 to N. A. Hirsch. The basic design for these two piece clips has changed little over the last seventy years.

The above two piece spring clips provided an improvement over prior one piece retention clips. The prior art one piece clips were wire forms or stamped metal which did not have any spring action. Rather, they simply slid over a button stem and retained a garment in place with simple gravitational forces. Thus, there was no spring tension to hold a clip onto the stem of a button. In certain applications, such as on children's clothing and during transportation of garments such as overalls, these prior art one piece clips were prone to falling off. The two piece clips providing spring action to engage buttons provided significant advantages over the prior art one piece clips and have been used extensively over the last seventy-five years.

Although two piece spring clip have been used extensively, two piece button clips may be subject to unwanted deformation and breaking as a result of repeated washing in washing machines. When a garment using such a clip is washed the two piece clip may become entangled with other garment or pieces of the machine which pull on the wire loop or the encasement and cause the encasement to become loose or otherwise fall off. Although some manufacturers claim that certain configurations of encasements may provide improved performance over other designs in this respect, the problem persists and is inherent to any two piece loop.

As a result, one piece clips are still in use today. Examples of such devices are shown in U.S. Design Pat. Nos. 306,272 to J. B. Kruger and 56,042 to De Ver H. Warner, and U.S. Pat. Nos. 1,695,056 to C. A. Mosgrove; 3,911,537 to H. E. Mazur. In some case button loops have been formed from a single piece of sheet metal or plastic material, see, e.g., U.S. Design Pat. No. 358,567 to W. A. Sirois and U.S. Pat. No. 4,204,300 to G. Fildan.

As with the original one piece retention clips, clips which are formed from a single piece of material or which are otherwise retained together through either a weld or support element tend to be too rigid and do not provide enough lateral movement to engage and disengage a metal button with ordinary spring force. In addition, spring clips which employ support elements to retain the wire form together provide another disadvantage because the overlapping materials used as a support member prevent a full application of plating and other coating materials on pieces of the material which are covered below the support structures. In addition, pieces which are welded together tend to be problematic because they are subject to breakage after extensive use and washing.

To the extent that single wire button loops are formed to provide the necessary shape without welding or a support element to retain the wire ends together, i.e., the ends of the wire are simply put in an abutting relationship, the clip becomes subject to deformation upon repeated use and washing.

SUMMARY OF THE INVENTION

It is therefore an object of the present invention to provide an improved spring clip which provides resilient lateral movement of a button receiving portion.

It is a further object of this invention to provide an improved spring clip which may be manufactured from a single piece of wire.

The spring clip of the present invention is provided with a horizontal strap bar having interlocking sliding elements, a pair of arms extending from the horizontal bar and a button receiving portion for resiliently engaging a button like element.

BRIEF DESCRIPTION OF THE DRAWINGS

The present invention will be understood and appreciated more fully from the following detailed description, taken in conjunction with the drawings, in which.

DETAILED DESCRIPTION OF THE INVENTION

By way of example, the present invention is illustrated in terms of a spring clip used to secure a strap of a garment on a button type projection. The example application described herein is only one example application of the present invention and is provided for the purpose of better explaining the present invention. The present invention may be applied to any number of other clips. Thus, the present invention should not be limited to the specific example described herein.

Figure 1:
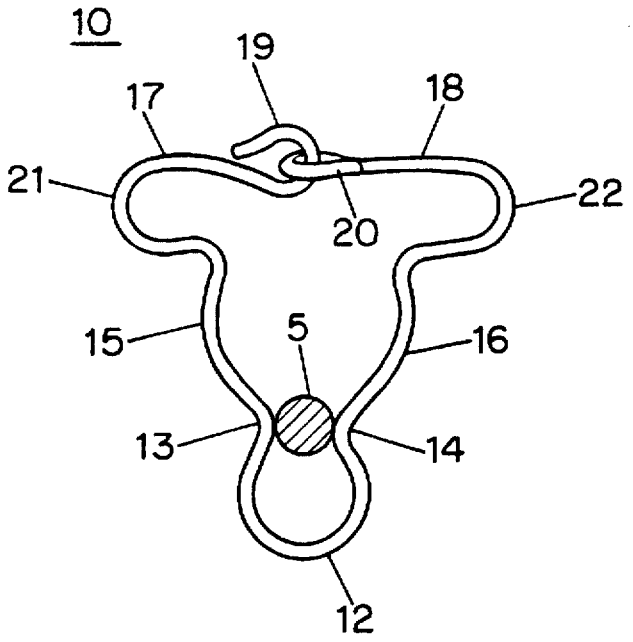
FIG. 1 is a perspective view of a preferred embodiment of a spring clip in a partially opened position during the engagement of a button.
Figure 2:
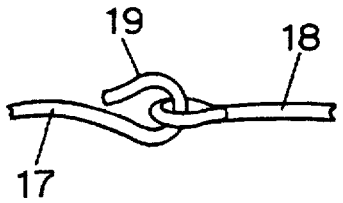
FIG. 2 is a partial front view of the sliding horizontal bar of the spring clip of FIG. 1.
Figure 3:
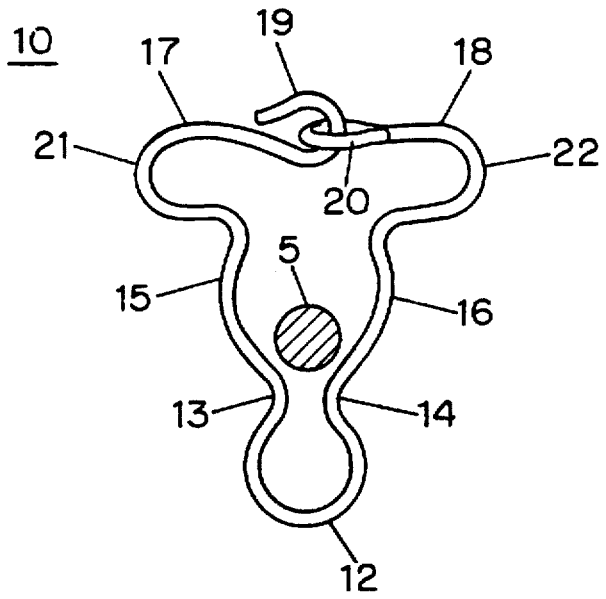
FIG.3 is a perspective view of a spring clip of FIG. 1 in a closed position prior to engaging a button.

Illustrated in FIG. 1 is a preferred embodiment of a spring clip of the present invention. In the preferred embodiment, the spring clip 10 is formed from a single piece of metal wire. The wire is bent to provide a button receiving portion 12, two bowed arms and a horizontal strap bar formed by two interlocking lateral elements 17 and 18.

The button receiving portion 12 is shaped and sized to receive the stem of a button type projection 5. Upon the application of pressure by the button stem projection 5 on the walls of the button receiving portion 12, the inwardly bowed sections of the button receiving portion 13 and 14 are spread from their biased closed position and receive the button stem projection 5 until the button stem projection 5 is secured in the button receiving portion 12. Once the button stem 5 passes through the entry point defined by the bowed sections 13 and 14 it rests within the circumference of the button receiving portion 12 and is maintained in the button receiving portion 12 by the inwardly bowed section 13 and 14 which return back to their normally closed biased position.

Spring clip 10 is provided with bowed arms 15 and 16 which are bent to bias the inwardly bowed sections 13 and 14 of the button receiving portion 12 in a closed position. When the button stem projection slides through the inwardly bowed sections 13 and 14, the inwardly bowed sections 13 and 14 and the arms 15 and 16 move in a lateral outward open position. The motion of the arms 15 and 16 is translated to the sliding horizontal bar elements 17 and 18. The horizontal sliding bar elements have interlocking ends 19 and 20 which are bent to form generally closed apertures engaged in an interlocking manner such as to limit the amount of lateral movement of the arms 15 and 16, and consequently the inwardly bowed sections 13 and 14. This limit is necessary for keeping the inwardly bowed sections 13 and 14 from opening to such an extent as to permanently deform the button receiving portion 12.

The interlocking ends 19 and 20 of the horizontal bar elements 17 and 18 are formed by bending the wire upon itself. When the ends of the wire are cut, they are preferably cut in a manner such as to avoid sharp edges and then folded near to the horizontal bar elements 17 and 18. Again, it is preferred that these ends be closely positioned to the wires so as to avoid possible engagement of the ends to any other piece of material during washing or use.

The spring clip described above may be easily coated with any number of coating materials used in the industry, such as nickel-color electroplating.

What is claimed is:

1. A unitary spring garment clip formed from a single piece of wire form having a first and second end for securing a garment strap in a fixed position relative to a button without exposing either ends of the wire form, said clip comprising:

a sliding horizontal bar for inserting into a receiving portion of said garment strap, said bar having two interlocking elements near the center of said horizontal bar formed with the first end and the second end of said wire form for limited resilient expansion of the sliding horizontal bar, a generally circular resilient button receiving portion formed from a center portion of said wire form for engaging and disengaging said button, and a pair of non-intersecting arms formed from the single piece of wire form coupling said sliding horizontal bar to said button receiving portion and for translating the resilient motion of said button receiving portion to said sliding horizontal bar.

2. A spring garment clip formed from a continuous wire form for engaging and disengaging a button, said spring clip comprising a pair of non-intersecting spring arms having a first contracted end and a second contracted end positioned to form a button receiving opening and a pair of strap bar receiving ends, a button receiving portion coupled to the contracted ends of the pair of arms, and a horizontal bar coupled to the pair of strap bar receiving ends, said horizontal bar being formed by a pair of interlocking portions near the center of the horizontal bar providing for the expansion of the horizontal bar upon the expansion of the button receiving portion of the spring clip.

3. An improved garment clip formed from a single piece of resilient wire, said clip including a button receiving portion for engaging and disengaging a button, a horizontal bar and a pair of arms connecting said horizontal bar to said button receiving portion, wherein said improvement comprises interlocking means near the middle of the horizontal bar on the horizontal bar to permit limited non-deforming resilient movement of the button receiving portion of the spring clip upon the repeated engagement and disengagement of the button and the pairs of arms are not intersecting.

* * * * *